US008418997B2

(12) United States Patent
Bastone

(10) Patent No.: US 8,418,997 B2
(45) Date of Patent: Apr. 16, 2013

(54) EXTENDABLE SUPPORT COLUMN

(76) Inventor: Frank Bastone, Woodbridge (CA)

( * ) Notice: Subject to any disclaimer, the term of this patent is extended or adjusted under 35 U.S.C. 154(b) by 696 days.

(21) Appl. No.: 12/588,668

(22) Filed: Oct. 23, 2009

(65) Prior Publication Data

US 2011/0097180 A1 Apr. 28, 2011

(51) Int. Cl.
*B66F 7/28* (2006.01)

(52) U.S. Cl.
USPC ..... 254/93 R; 254/134; 254/10 B; 52/122.1; 52/126.6; 187/9

(58) Field of Classification Search ..... 254/93 R, 254/133 R, 134, 100, 10 B, 10 C, 2 B; 52/122.1, 52/126.6; 187/203, 9; 248/404, 354.1; 414/11; 405/272, 278, 290
See application file for complete search history.

(56) References Cited

U.S. PATENT DOCUMENTS

| | | | | |
|---|---|---|---|---|
| 4,601,141 | A * | 7/1986 | Donnelly | 52/126.6 |
| 4,657,112 | A * | 4/1987 | Ream et al. | 182/69.4 |
| 6,273,662 | B1 * | 8/2001 | Fleckenstein | 414/11 |
| 6,394,405 | B1 * | 5/2002 | Roxton et al. | 248/354.1 |
| 2005/0161648 | A1 * | 7/2005 | Oudelaar | 254/93 R |
| 2009/0134375 | A1 * | 5/2009 | Shi | 254/93 H |
| 2011/0097180 | A1 * | 4/2011 | Bastone | 414/10 |

* cited by examiner

*Primary Examiner* — Lee D Wilson

(57) ABSTRACT

A support column apparatus for supporting and moving a portion of a building, and having a base column of square tubular cross section, a top extension column of square tubular cross section sliding within the base column, an hydraulic cylinder within the base column, a piston and a piston rod extendable into the said top extension column, and, a hydraulic connection to supply hydraulic fluid to the cylinder.

11 Claims, 4 Drawing Sheets

28
22
36
76
12

32
30
76
34
16
36
76
28
22
36
10
12
78
14
18
20

EXTENDABLE SUPPORT COLUMN

FIELD OF THE INVENTION

The invention relates to temporary extendable support columns, for supporting a portion of a building during construction. Typically a plurality of such columns will be used to lift and support the roof of a building, during renovations or alterations.

BACKGROUND OF THE INVENTION

In construction, it is frequently desirable to support a portion of a building under construction or under renovation. For this purpose temporary support columns are used. A wide variety of such columns have been proposed in the past. However most of such columns have been designed for the purpose of merely holding a floor or roof in position while other work is done. Simple columns are available which have threaded extensions. These columns are extendable only to a limited extent. The purpose, in such columns is usually to facilitate the erection of the columns, and to be extended to support a structure, and not to actually raise part of the building.

In certain cases particularly renovation or alteration of a building, it is desirable to not only support a structure with plurality of such columns, but also to raise, or lower such a portion of a building which is supported on such columns.

In this case, where the elevation of the supported building portion is to be changed, it is essential that the supported portion of the building shall be maintained level, or at its predetermined orientation. For example, if it is desired to renovate or alter a building by for example elevating the entire roof of the building or a portion of the roof of the building to a new elevation, then clearly the entire roof that is to be moved must be supported and raised or lowered to a new position. The entire portion of the building that is to be moved must be moved without changing its plane or shape. The supporting structure used for this purpose must be capable of carrying that load and holding it in a new position for as long it takes to complete the other alterations or renovations of the building.

In the past, this has generally speaking being achieved in a some what unsatisfactory manner.

BRIEF SUMMARY OF THE INVENTION

With a view to providing an improved form of extendable support column apparatus for supporting and moving a portion of a building, the invention provides a support apparatus having, a base column, an extension column assembly telescopically connected with said base column, a hydraulic cylinder, and piston, within the columns, operable to extend the extension column assembly, a hydraulic connection, whereby hydraulic fluid may be either admitted into or discharged from said cylinder for moving said extension column assembly relative to said base column.

Preferably, the extension column assembly will comprise at least one intermediate column, within said base column, and a top column within said intermediate column.

Preferably, the invention provides a base column of hollow tubular rectangular construction, a foot at one end of said base column the other end of said base column being open, and said extension column assembly being telescopically received within said base column for extending and retracting therefrom.

Preferably, the invention provides an opening in said base column for supply, or release, of hydraulic fluid to and from said cylinder for extending, or retracting said piston.

Preferably, the piston has a piston rod, with at least two shims slidable within said columns, and an abutment device on said piston rod, for engaging and moving the shims.

Preferably, the invention provides such an apparatus wherein the intermediate column is a square tubular hollow body, open at each end, and having guide means at one end, for guiding sliding movement of said piston rod.

The invention also provides a hydraulic control system, adapted to be connected to a plurality of said support column apparatus, said hydraulic control system being adapted to supply hydraulic fluid under pressure to all said support column apparatus, for extending or retracting said pistons, in a coordinated and controlled manner.

Preferably the invention will also provide a visual or other indication on said support column apparatus indicating the length of the extension of said support column apparatus.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

FIG. 1*a* is a perspective illustration of a typical support column apparatus illustrating the invention, with the environment of a building interior shown schematically, partially cut away, and showing a hydraulic control unit;

FIG. 1*b* is a perspective of a portion of a support column of FIG. 1*a*, partially cut away;

Figure 5A:
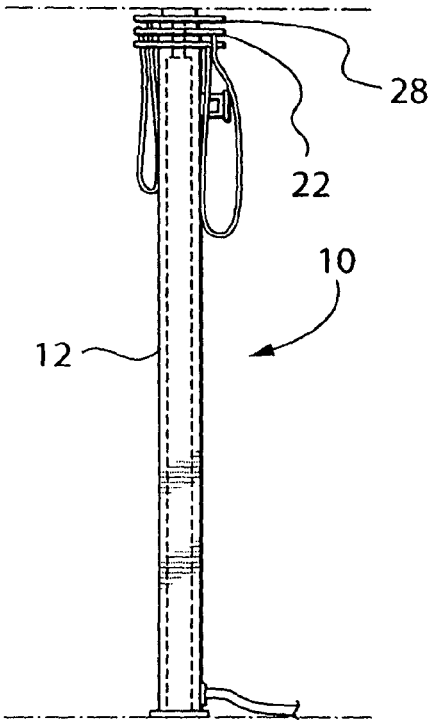
Figure 5B:
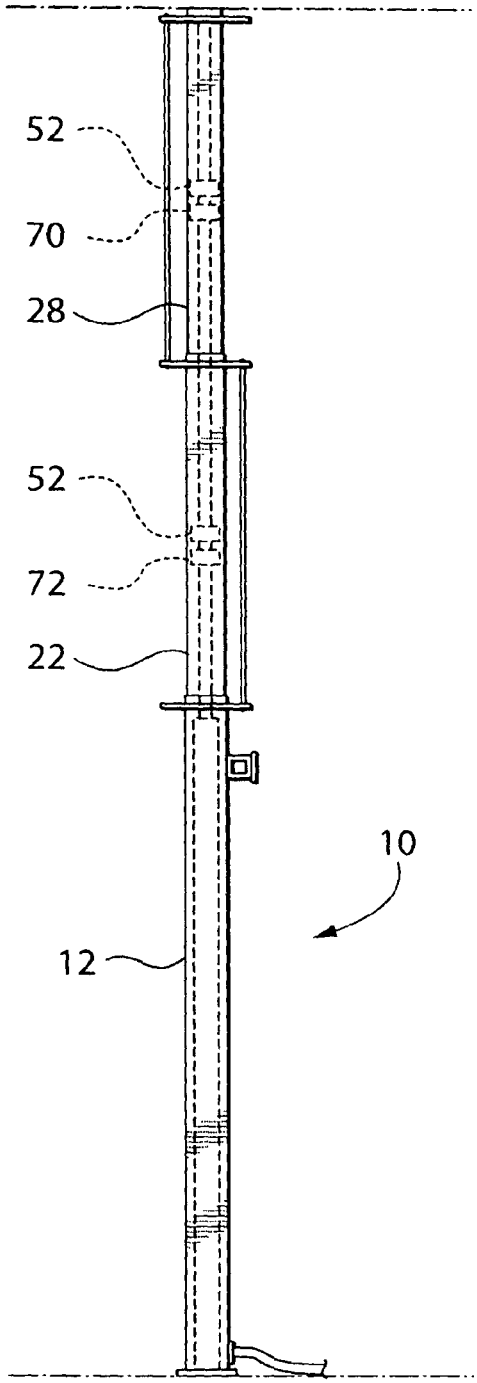

FIG. 5*a* is a schematic elevation showing a retracted position; and,

FIG. 5*b* corresponds to FIG. 5*a* is an extended position,

DESCRIPTION OF A SPECIFIC EMBODIMENT

As discussed above, the invention provides a support column apparatus, by means of which a roof or portion of a building under renovation or alteration can be raised (or lowered), without dismantling that portion of the building or altering it. The portion of the building, typically the roof, with or without a surrounding part of the structure, if attached to the roof, may be separated from the remainder of the building and raised (or lowered) to a new elevation. Typically in this type of renovation or alteration, the gap between the existing structure and the raised roof will then be filled in by erecting further structure, until the structure reaches the desired height. When the structure is at the appropriate new level, then the support column apparatus is then operated in reverse and retracted down, so as to allow the roof and any attached structure, to be lowered onto the new structure. The support column apparatus is then removed, for use in a further building renovation elsewhere.

It will be appreciated that in this operation, it is essential that the support column apparatus, which will in most cases be a large number of such support columns, shall be spaced apart on the floor of a building fabric, beneath the roof. The support column apparatus may be operated so as to raise the roof structure in increments, while maintaining the roof structure level and unchanged from its original construction. This preserves the fabric of the roof, so that it does not become stretched or twisted and can be replaced in its new position, undamaged.

The support column apparatus once in position must be maintained stable at that new level, while the renovations on the structure or surrounding parts of the building are completed.

In addition to performing these various functions at a job site, it is also clearly necessary that the support column apparatus maybe retracted into a length which can be carried from one job site to another, and for this purpose it is necessary that it shall be retractable telescopically.

Figures 1A, 1B:
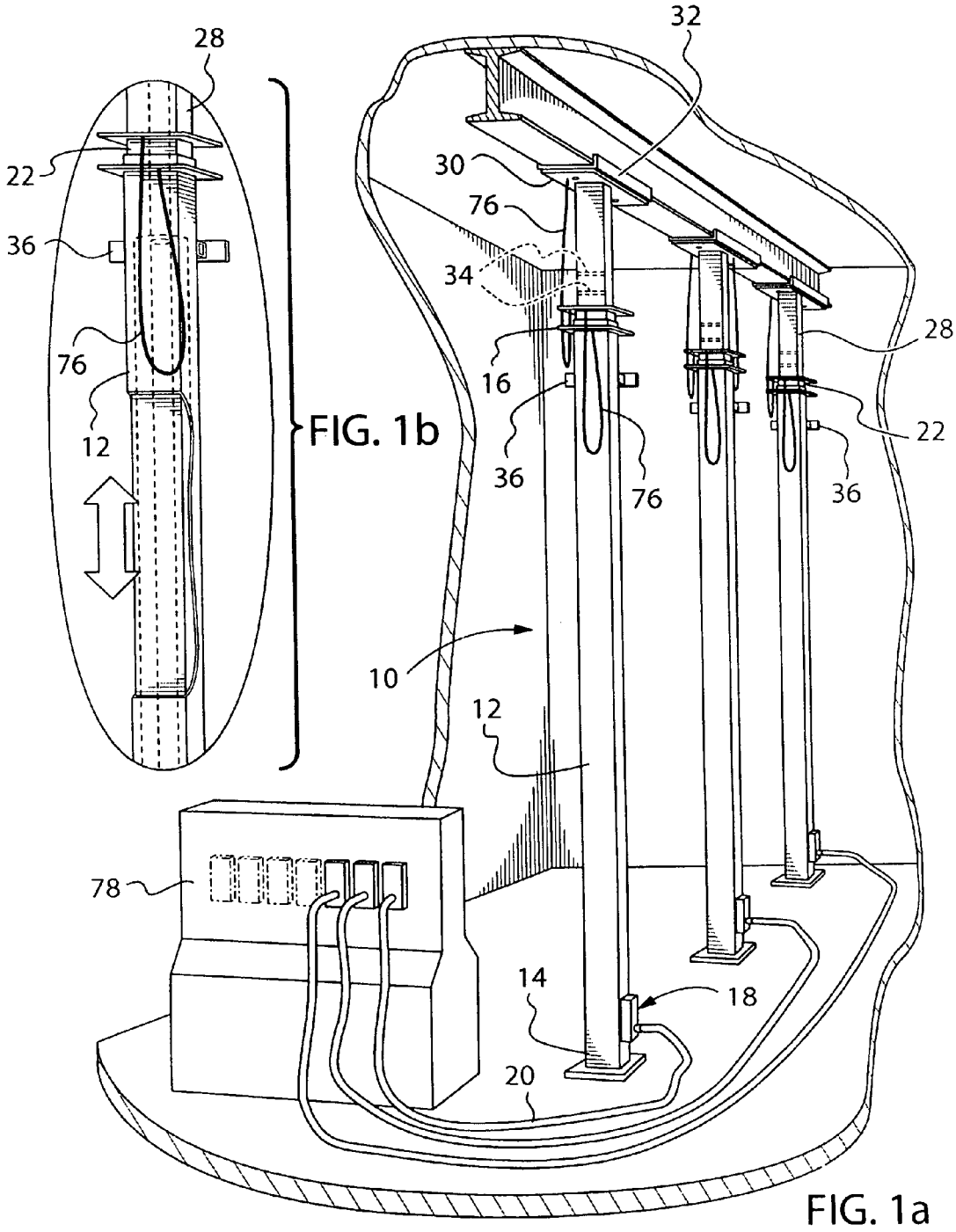
Figure 2:
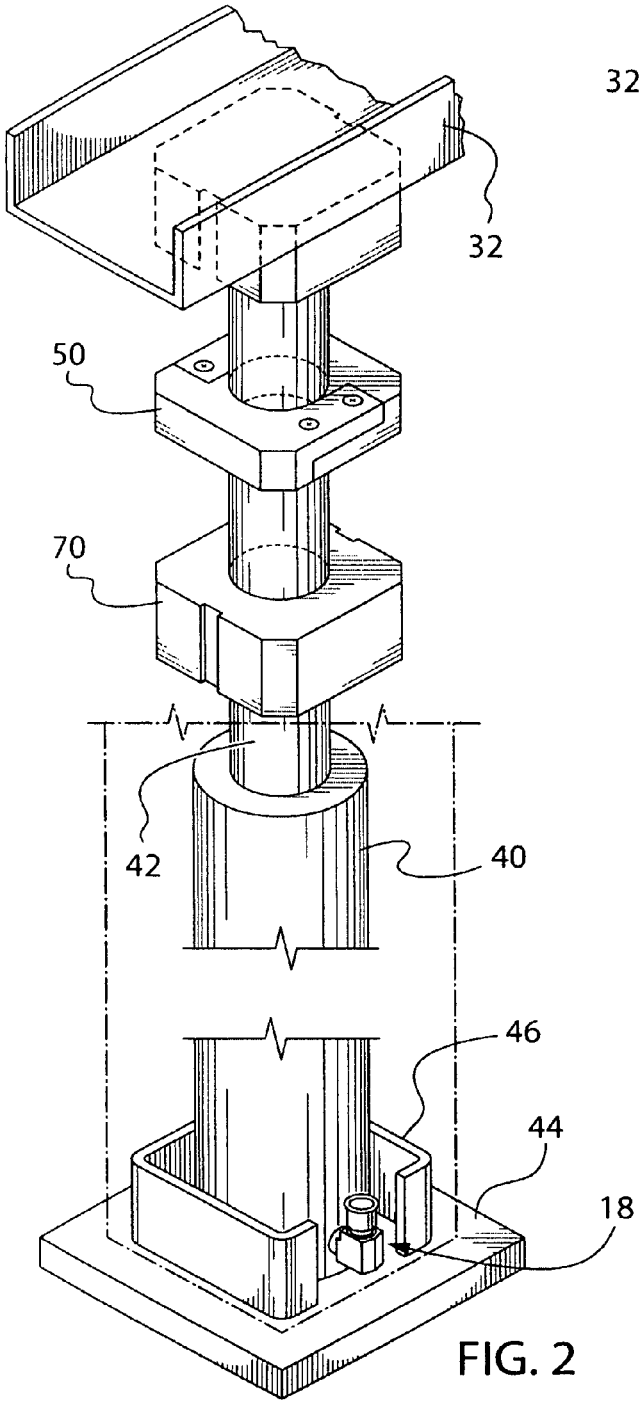
FIG. 2 is an enlarged perspective of FIG. 1*b*, cut away.
Figure 3:
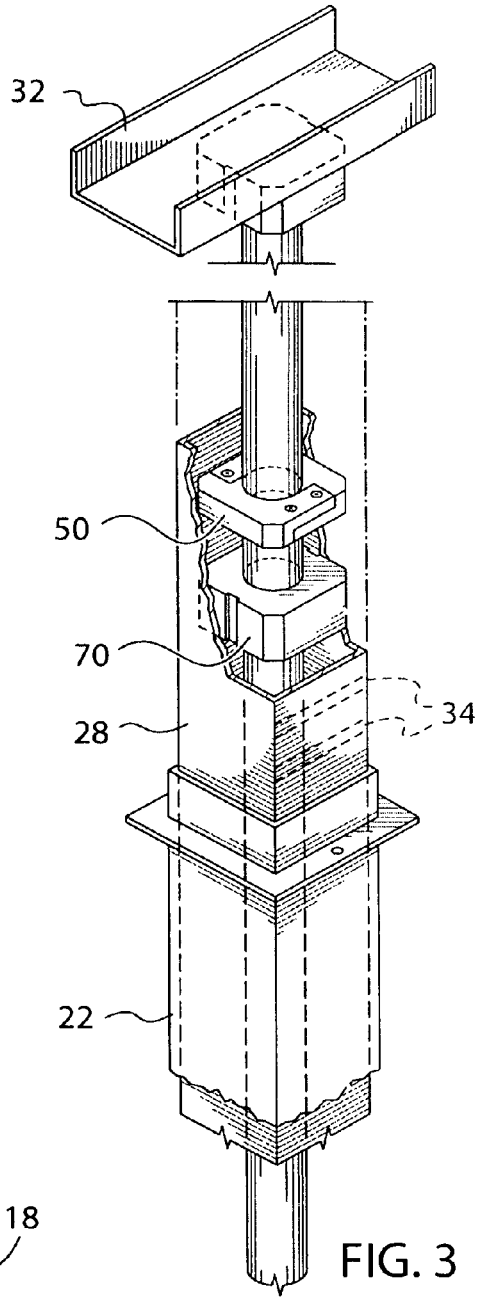
FIG. 3 is a schematic perspective of FIG. 1*b*, and cut away.

Referring to FIGS. 1, 2 and 3, it will be seen that the invention is there illustrated in the form of a support column apparatus (10), having a base column (12), a lower end (14), and being open at its upper end (16). The base column (10) is of hollow square tubular construction. The base column (10) is provided with a hose connector opening (18) for receiving an hydraulic hose coupling (20).

An intermediate extension column (22) is provided, also of square tubular construction, which fits within and is movable telescopically, relative to base column (10).

For reasons that will be come apparent, the intermediate column (22) is hollow through its interior, and is open at its lower and upper ends (24) and (26).

A further or top extension column (28) is provided, also of square tubular construction, located within and movable telescopically relative to the intermediate extension column (22).

At its upper end, the top extension column (28) is provided with a cap (30), which is adapted to engage part of the building fabric, typically a beam or joist supporting the interior of the roof, for raising the roof.

A top clamp (32) formed of plates and bolts permits the upper end on the top extension column (28) to be clamped to the underside of a beam or joist (J).

The intermediate extension column (22), and also the top extension column (28), are provided with visual extension indicators (34), on the exterior, and may also be provided with electrical or electronic extension sensors or indicators (not shown), for detecting movement of length of the extension of the intermediate or top extension column (28).

Side brackets (36) are attached to base column (10). Side brackets (36) may be secured to part of the building fabric, such as a wall or an existing, adjacent building column, for stability.

In order to provide power to extend and retract the top and intermediate extension columns, a hydraulic system is provided. This system consists of a hydraulic cylinder (40) and a piston rod (42) extending from the cylinder. The cylinder (40) and piston rod (42) are located within the base column (10) and intermediate and top columns (22) and (28).

The lower end of cylinder (40) has a base plate (44) and a collar (46). Collar (46) fits within the lower end of base column (12).

Figure 4:
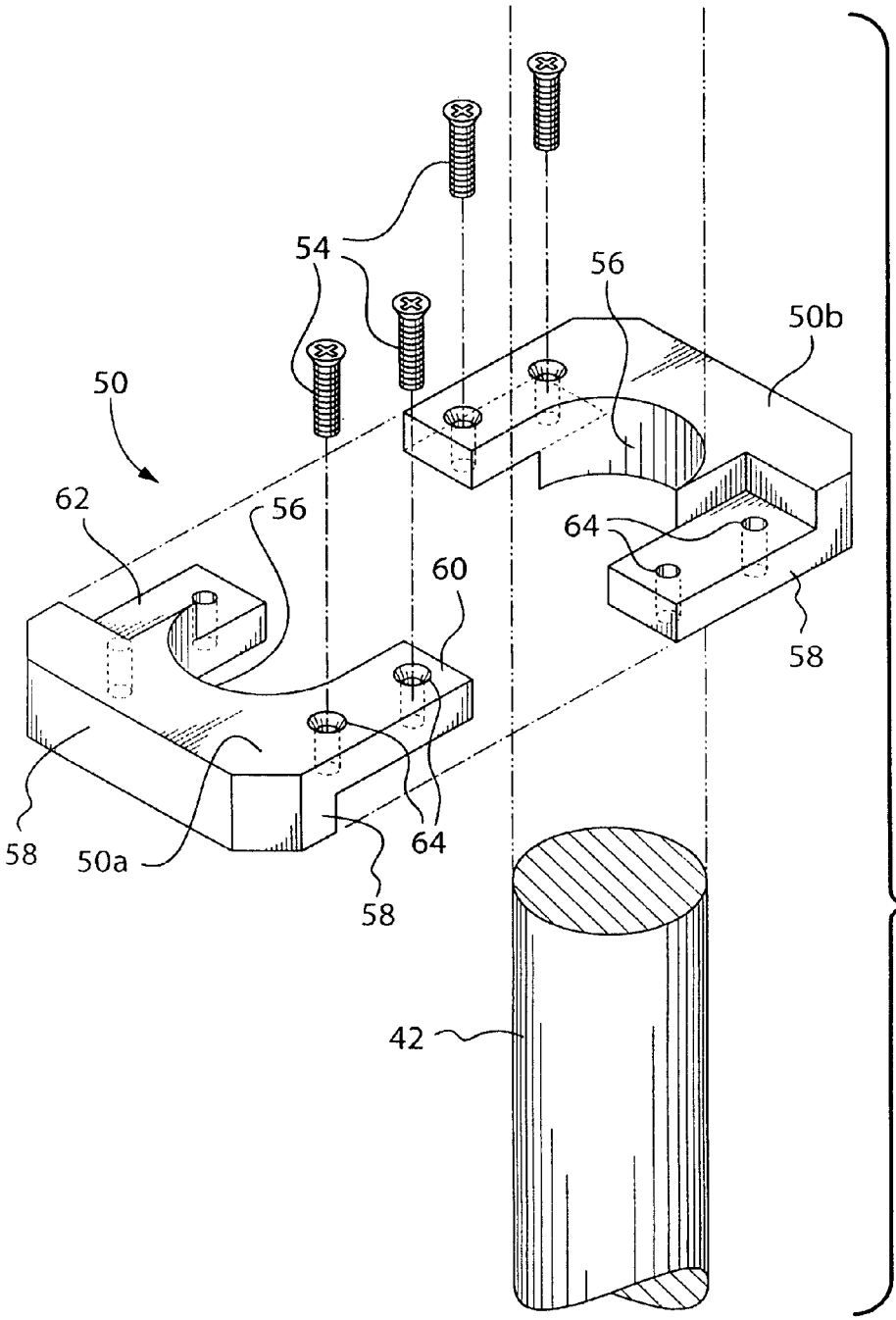
FIG. 4 is an exploded perspective of a two component sliding shim, and piston rod.

Within the intermediate and top columns there are sliding shims (50) and (52), (FIGS. 2 and 4). Shims (50) and (52) are formed in two halves (50*a*-50*b*), joined together by bolts (54) so as to fit around piston rod (42). They define inner semi-arcuate surfaces (56) to make a sliding fit around the piston rod (42) and have outer square sliding surfaces (58) which are sized to engage the interior surface of either intermediate column (22) or top column (28), respectively. Upper and lower arms (60) and (62) on the shim components are shaped to inter-digitate. Bolt opening (64) register with one another to receive fastenings (66).

Mid way stop (70) is attached to the top extension column (28) and located so as to engage respective shims (52). Mid way stop (72) is attached to intermediate extension column (22) In this way respective shims (50) or (52) are extended along respective intermediate or top columns (22) or (28). Thus, as the columns are extended, the shims (50) and (52) function to maintain the piston rod stable and centred within the respective columns. Tethers (76) connect the base, and intermediate and top column. Tethers (76) are of flexible wire rope. An hydraulic pump and control unit (78) is connected to the cylinders (40).

In operation the columns are set up in a building. The base columns are secured to the building structure and the hoses are connected to a pump supply for hydraulic fluid. The cylinders are then extended until the top column reaches the desired location. The top ends are then secured. The same steps are repeated until a sufficient number of columns have been placed in position and secured.

Brackets may be attached from the base column to the building for stability. The roof, or other part of the structure to be raised is then separated from the rest of the structure so that it is free to be raised.

The pump is then operated to gradually extend all the columns. This will gradually raise the released portion of the structure. When it is at the desired height, then work can be started on raising the remaining structure until it reaches the desired new height. The fluid can then be gradually released from the columns. This will lower the raised portion of the structure, until it rests on the remainder.

The raised structure can then be reattached and secured to complete the job.

The columns are then released and lowered and can be removed ready for another job elsewhere. It will be apparent that the columns can also be used to in effect lower a roof or building structure down, after walls have been reduced in height.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A support column apparatus for supporting and moving a portion of a building, comprising;

a base column of square tubular cross section;

a top extension column of square tubular cross section dimensioned to slide within said base column and be telescopically received within said base column;

a hydraulic cylinder within said base column;

a piston in said cylinder and a piston rod extendable from said hydraulic cylinder into the interior of said top extension column;

shims in said top extension column slidably engaging said piston rod and having square exterior surfaces for engaging the interior of said top column, said shims being of two component construction, each shim component defining a semi cylindrical surface for engaging said piston rod, and a rectangular exterior surface for engaging the interior of said column and fastenings for securing said two components around said piston rod; and, a hydraulic connection, whereby hydraulic fluid may be either admitted into or discharged from said cylinder to extend said piston rod for moving said top extension column relative to said base column, or to retract it.

2. A support column apparatus as claimed in claim 1 including at least one intermediate column between said base column and said top extension column, and said piston rod extending through the interior of said intermediate column, wherein said cylinder has as upper and a lower end.

3. A support column apparatus as claimed in claim 1, wherein said cylinder has an upper and a lower end, including a foot at the lower end of said cylinder, and a hose connection adjacent to said foot for connecting an hydraulic hose to said hydraulic cylinder within said base column.

4. A support column apparatus as claimed in claim 1 including support brackets on said base column for securing said base column to a portion of a building structure.

5. A support column apparatus as claimed in claim 1 including stop abutments in said top column for engaging said shims and moving said shims with said piston rod.

6. A support column apparatus as claimed in claim 5 including an intermediate extension column within said base column, and wherein said top extension column makes a sliding fit within said intermediate column.

7. A support column apparatus as claimed in claim 6 including intermediate shims within said intermediate column and top shims within said top column.

8. A support column apparatus as claimed in claim 6 including a visual indicator on each of said intermediate column and said top column indicating the length of the extension of each of said intermediate and top columns.

9. A support column apparatus as claimed in claim 5 including a group of said support column apparatus, and including an hydraulic pump for pumping hydraulic fluid to all said base columns in said group whereby to extend all said columns in said group simultaneously.

10. A support column apparatus as claimed in claim 1 wherein each shim component defines a semi cylindrical surface portion, and an upper arm extending from one end of said semi cylindrical surface portion, and a lower arm extends from the other end of said semi cylindrical surface portion, and bolt openings extending through said arms, said arms inter-digitating with one another on respective shim components with said bolt openings in registration for receiving fastenings wherein.

11. A support column apparatus as claimed in claim 6 including flexible wire rope tethers extending between said base column and said intermediate column, and between said intermediate column and said top column.

* * * * *